US006189467B1

(12) United States Patent
Tomita

(10) Patent No.: US 6,189,467 B1
(45) Date of Patent: Feb. 20, 2001

(54) SEWING MACHINE HAVING A DISPLAY DEVICE

(75) Inventor: Shintaro Tomita, Nagoya (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/605,541

(22) Filed: Jun. 29, 2000

(30) Foreign Application Priority Data

Jul. 15, 1999 (JP) ..... 11-201375

(51) Int. Cl.[7] ..... D05B 19/12

(52) U.S. Cl. ..... 112/102.5; 112/470.06; 112/475.19; 700/138

(58) Field of Search ..... 112/102.5, 470.01, 112/470.04, 470.06, 475.19, 445, 454, 456, 458; 700/136, 137, 138

(56) References Cited

U.S. PATENT DOCUMENTS 5,836,259 * 11/1998 Tanaka ..... 112/102.5
5,894,294 * 4/1999 Morita ..... 700/136
5,996,517 * 12/1999 Tomita ..... 112/102.5
5,996,518 * 12/1999 Tomita ..... 112/470.01
6,095,067 * 8/2000 Tomita et al. ..... 112/102.5

* cited by examiner

*Primary Examiner*—Peter Nerbun
(74) *Attorney, Agent, or Firm*—Oliff & Berridge, PLC

(57) ABSTRACT

In a sewing machine, a CPU reads a color display data of an embroidery pattern selected by a user from a ROM and generates a subtractive color data by subtracting colors included in the color display data. The CPU then writes the subtractive color data into a non-volatile storing medium, such as a flash memory. Therefore, the non-volatile storing medium can store more pattern data of the embroidery patterns, compared with the case where it stores the color display data whose data amount is large. That is, the storage capacity of the non-volatile storing medium can be smaller, so that the manufacturing costs can be reduced.

23 Claims, 15 Drawing Sheets

SEWING MACHINE HAVING A DISPLAY DEVICE

BACKGROUND OF THE INVENTION

1. Field of Invention

The invention relates to a sewing machine capable of embroidering, specifically to a sewing machine that subtracts colors included in color display data and generates a subtractive color display data, then writes the subtractive color data into a non-volatile storing medium.

2. Description of Related Art

Conventionally, in an electronically-controlled sewing machine capable of embroidering on a work cloth (hereinafter referred to as an embroidery sewing machine), pattern data for various types of embroidery patterns are stored in a ROM provided in the sewing machine or in a ROM of a ROM card, which is removably inserted into the embroidery sewing machine. A desired embroidery pattern is selected from the various embroidery patterns stored in the ROM. Based on sewing data included in the selected pattern data, an embroidery frame is controlled to move back/forth and right/left, and a needle (a needle bar) moving up and down and a rotary hook are also controlled their movements, and thus the embroidery pattern is embroidered on a work cloth held by the embroidery frame.

Further, the embroidery sewing machine is generally provided with a display. A selected embroidery pattern is displayed on the display based on display data included in pattern data of the selected embroidery pattern, so that an operator confirms the selected embroidery pattern. Further, by performing key operations with editing keys, one or a plurality of embroidery patterns can be edited (e.g., changing the arrangement, enlargement/reduction, or rotation of the pattern) in a pattern display area that corresponds to the embroidery frame.

An embroidery sewing machine in which the display data and the sewing data are rewritably stored in a nonvolatile storing medium, such as a flash memory, has come into practical use, so that once a selected/edited embroidery pattern is set, it can be sewn without selecting/editing it again. In such an embroidery machine, the embroidery pattern is confirmed by displaying the embroidery pattern based on display data stored in the nonvolatile storing medium. When the embroidery pattern is determined as the embroidery pattern to be sewn, the sewing operation of the embroidery pattern can be executed based on sewing data stored in the nonvolatile storing medium.

Recently, there is an embroidery sewing machine that is provided with a color display to display an embroidery pattern in actual colors when the embroidery pattern is colored.

In the embroidery sewing machine that displays the embroidery pattern on the display in color, the data amount for the color display data becomes enormous. For example, the data amount of one dot for displaying the embroidery pattern in black and white is one bit. When the embroidery pattern is displayed in 256 colors, the data amount of one dot requires one byte. Further, when the embroidery pattern is displayed in 640 million colors, the data amount of one dot requires two bytes. Actually, thousands of thread colors can be used for embroidering, so that one dot is expressed by one byte or more of the data.

Therefore, the color display data having the enormous amounts of data has to be stored in the nonvolatile storing medium. Accordingly, in order to store certain amounts of the selected/edited embroidery data in the nonvolatile storing medium, the storage capacity of the nonvolatile storing medium needs to be made large, so that the manufacturing costs may increase.

In another conventional embroidery sewing machine that displays the embroidery pattern on the display in black and white, the data amount of the display data is small even when the pattern data of the embroidery pattern is stored in the nonvolatile storing medium, so that the storage amount of the nonvolatile storing medium does not need to be enormous. However, the selected/edited embroidery data can not be displayed on the display in color, so that the embroidery pattern can not be confirmed in the actual colors. Accordingly, it is difficult for an operator to image a finished embroidery pattern.

SUMMARY OF THE INVENTION

The invention will be described in the context of a sewing machine capable of embroidering, that subtracts, or removes, colors included in color display data and generates a subtractive color display data, then writes the subtractive color data into a non-volatile storing medium so that a memory amount of the non-volatile storing medium can be made smaller. The invention is applicable to a machine for any type of structured pattern sewing that might require groups of stitches having different colors.

In this regard, the sewing machine capable of embroidering or sewing a complex, structured pattern on a work cloth of the embodiment of the invention may include a pattern data reading device that reads an embroidery, or structured, pattern data including color display data and sewing data from an embroidery pattern data storing device, a display device including a color display that displays the embroidery pattern based on the color display data read by the pattern data reading device, a pattern selecting device that selects one of embroidery pattern, a color subtracting device that subtracts the colors included in the display data for the selected embroidery pattern and generates subtractive color display data, a pattern data writing device that writes the subtractive color display data into a non-volatile storing medium, and a display controller that controls the display device to display a subtractive color embroidery pattern based on the subtractive color display data stored in the non-volatile storing medium.

According to the sewing machine structured as described above, the color subtracting device subtracts colors included in the display data for the selected embroidery pattern and generates subtractive color display data. And the pattern data writing device writes the subtractive color display data into the non-volatile storing medium. Therefore, the non-volatile storing medium can store more pattern data of the embroidery patterns, compared with the case where it stores the color display data whose data amount is large. That is, the storage capacity of the non-volatile storing medium can be smaller, so that the manufacturing costs can be reduced.

In a preferred aspect of the invention, the sewing machine may include an edit device that edits the embroidery pattern selected by the pattern selecting device, and the color subtracting device may generate the subtractive color display data based on the embroidery pattern edited by the edit device. Therefore, a user can set and sew one or a plurality of selected/edited pattern data as an embroidery pattern to be sewn without selecting/editing it again.

In a preferred aspect of the invention, the color subtracting device may generate a monochrome display data. As the data amount of the monochrome data is much smaller than that of the corresponding color display data, the storage capacity of the non-volatile storing medium can be made smaller and thereby the manufacturing costs can be reduced.

In a preferred aspect of the invention, the pattern data writing device may write sewing data and thread color data into the non-volatile storing device, and the sewing apparatus may include a color display data generating device that generates color display data based on the sewing data and the thread color data or based on the subtractive color data and the thread color data. Therefore, the color display data can be generated from the sewing data and the thread color data or from the subtractive color data and the thread color data whereas the storage amount of the non-volatile storing medium is not increased although the color display data is stored by storing the color display data in the non-volatile storing medium.

In a preferred aspect of the invention, the sewing machine may include a nonvolatile storing medium therein.

In a preferred aspect of the invention, the sewing machine capable of embroidering on a work cloth may include a pattern data reading device that reads an embroidery pattern data including sewing data and thread color data from an embroidery pattern data storing device, a color display data generating device that generates a color display data based on the sewing data and the thread color data read by the pattern data reading device, a display device including a color display that displays the embroidery pattern based on the color display data generated by the color display data generating device, a pattern selecting device that selects one of an embroidery pattern, a color subtracting device that subtracts colors included in the color display data for the selected embroidery pattern and generates a subtractive color display data, a pattern data writing device that writes the subtractive color display data into a non-volatile storing medium, and a display controller that controls the display device to display a subtractive color embroidery pattern based on the subtractive color display data stored in the non-volatile storing medium.

According to the sewing machine structured as described above, the color display data generating device generates color display data based on the sewing data and the thread color data read by the pattern data reading device. The color subtracting device subtracts colors included in the color display data for the selected embroidery pattern and generates a subtractive color display data. Then the pattern data writing device writes the subtractive color display data into a non-volatile storing medium. Therefore, the non-volatile storing medium can store more pattern data of embroidery patterns, compared with the case where it stores the color display data whose data amount is large. That is, the storage capacity of the non-volatile storing medium can be smaller, so that the manufacturing costs can be reduced.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Preferred embodiments of the invention will be described with reference to the accompanying drawings.

A first embodiment of the invention is an example of the invention being applied to an electronically-controlled sewing machine that enables sewing of various embroidery patterns by use of a detachable embroidery machine (an embroidery, or other work cloth holding, frame driving device).

Figure 1:
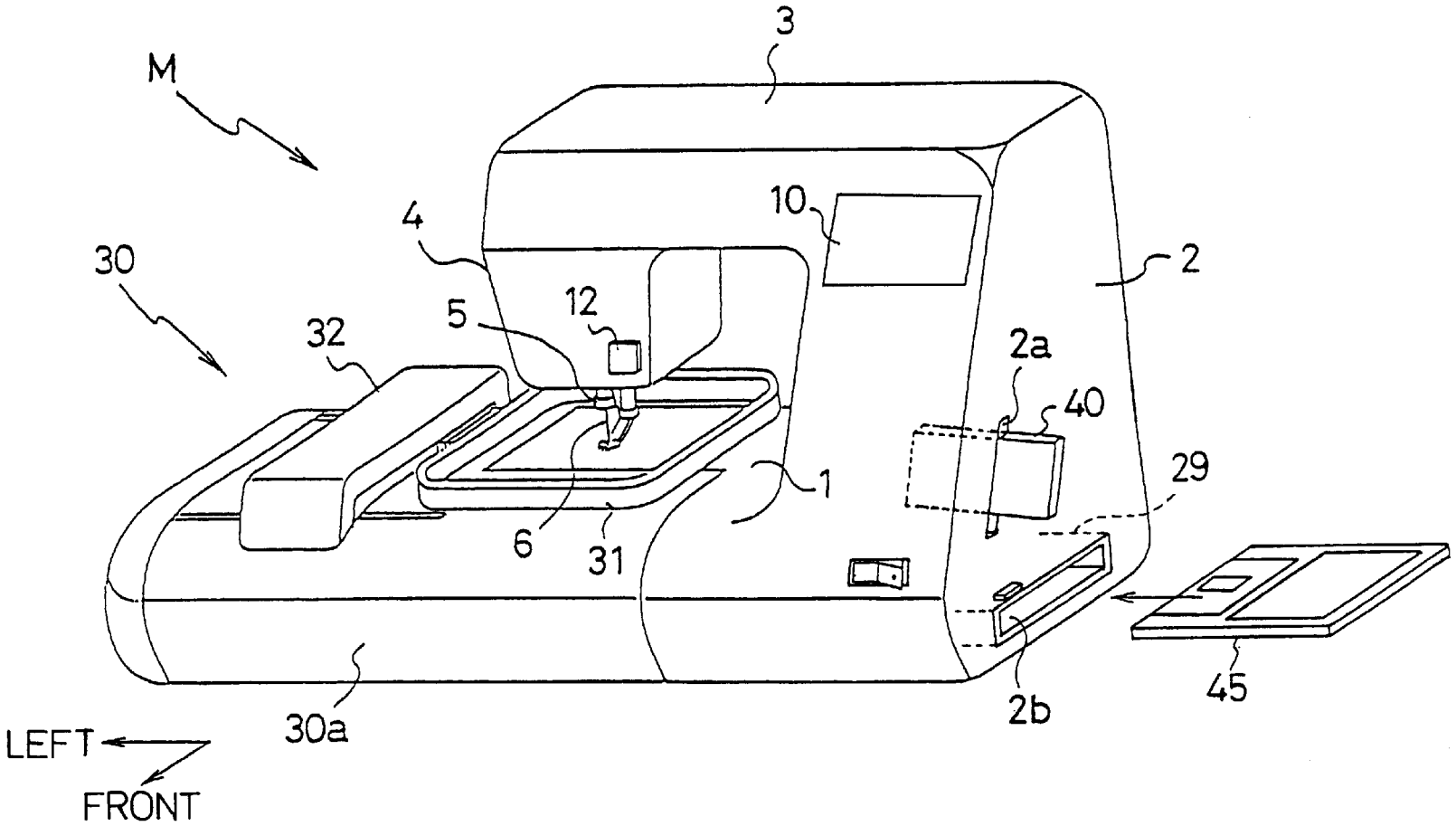
FIG. 1 is a perspective view of an electronically-controlled sewing machine according to an embodiment of the invention.

As shown in FIG. 1, the sewing machine M has a bed 1, a standard portion 2 that stands on the right of the bed 1, and an arm 3 that extends from the upper part of the standard portion 2 toward the left in parallel with the bed 1.

The bed 1 includes a feed dog up and down moving mechanism (not shown) that moves a feed dog up and down, a feed dog back and forth moving mechanism (not shown) that moves the feed dog back and forth, and a thread loop taker (e.g. a vertical axis oscillating shuttle) that contains a lower thread bobbin and can make stitches in cooperation with a needle 6 which moves up and down. The embroidery machine 30 is detachably fixed on a free bed, generally known as a free arm, of the bed 1.

Figure 2:
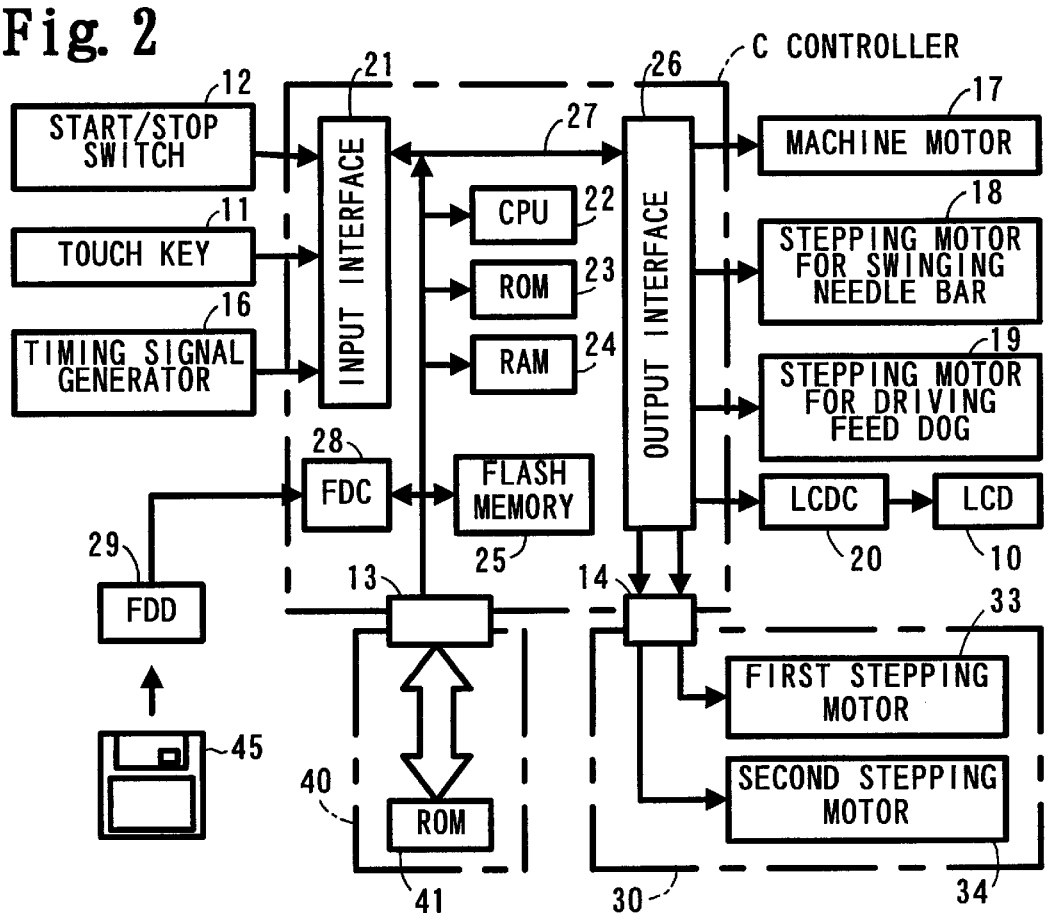
FIG. 2 is a control block diagram of the electronically-controlled sewing machine.

On the side of the standard portion 2, there is a slot 2*a* into which a ROM card 40 can be inserted to be connected to an internal connector 13 (see FIG. 2). Below the slot 2*a*, there is a floppy disk drive (FDD) 29 within the standard portion 2. The FDD 29 is provided with a slot 2*b* into which a floppy disk (FD) 45 is inserted.

On the front of the standard portion 2, a color liquid crystal display 10 (hereinafter referred to as a display) is provided. On the front of the display 10, a plurality of touch keys 11 (see FIG. 2), which are transparent electrodes and show functions on the display 10, are arranged in a grid. That is, of information displayed on the display 10, an order of functions, such as selecting or editing a desired embroidery pattern, can be effectuated simply by pressing a corresponding touch key 11.

The arm 3 includes a needle bar driving mechanism (not shown) that moves a needle bar 5, having the needle 6 at the bottom, up and down, a needle bar swinging mechanism (not shown) that swings the needle bar 5 in the direction perpendicular to a feed direction of a work cloth, and a thread take-up driving mechanism (not shown) that moves a thread take-up in accordance with the up and down movement of the needle bar 5. On the front of a machine head 4 of the arm 3, a start/stop switch 12, that orders a start and an end of the sewing operation, is provided. The feed dog up and down moving mechanism, the needle bar driving mechanism and the thread take-up driving mechanism are driven by a machine motor 17, the needle bar swinging mechanism is driven by a stepping motor 18 for swinging the needle bar 5, and the feed dog back and forth moving mechanism is driven by a stepping motor 19 for driving the feed dog back and forth (see FIG. 2).

The embroidery machine 30 has a housing 30*a*, an embroidery frame, or other work cloth holding device, 31 that can detachably hold a work cloth, a moving unit 32 including a Y-axis direction moving mechanism that moves the embroidery frame 31 in the Y-axis direction (back and forth), and an X-axis direction moving mechanism that is contained in the housing 30*a* and moves the moving unit 32 in the X-axis direction (right and left). The X-axis direction moving mechanism is driven by a first stepping motor 33 and the Y-axis direction moving mechanism is driven by a second stepping motor 34 (see FIG. 2).

When the embroidery machine 30 is attached to the free bed of the bed 1, the first and second stepping motors 33, 34 are electrically connected to a controller C on the machine M via a connector 14 (see FIG. 2). The controller C controls the operation of the stepping motors 33, 34, and the embroidery frame 31, in which a work cloth is set, is moved in the X- and Y-axis directions individually to perform an embroidering operation.

Next, the control system of the electronically-controlled sewing machine M will be described.

As shown in FIG. 2, the controller C comprises an input interface 21, a computer including a CPU 22, a ROM 23, a RAM 24 and a flash memory 25 (a nonvolatile storing medium that is electrically rewritable), an output interface 26, and a floppy disk controller (FDC) 28 that drives the FDD 29. These are connected to each other via a bus 27, such as a data bus.

The input interface 21 is connected to the start/stop switch 12, the plurality of touch keys 11, and a timing signal generator 16 that detects rotating phases of the sewing.machine main shaft. The output interface 26 is connected to motors 17, 18, 19, and a display controller (LCDC) 20 for the display 10. Further, the output interface 26 is connected to the first and second stepping motors 33, 34 of the embroidery machine 30 via the connector 14. The ROM 41 of the ROM card 40 is connected to the bus 27 via a connector 13.

Figure 3:
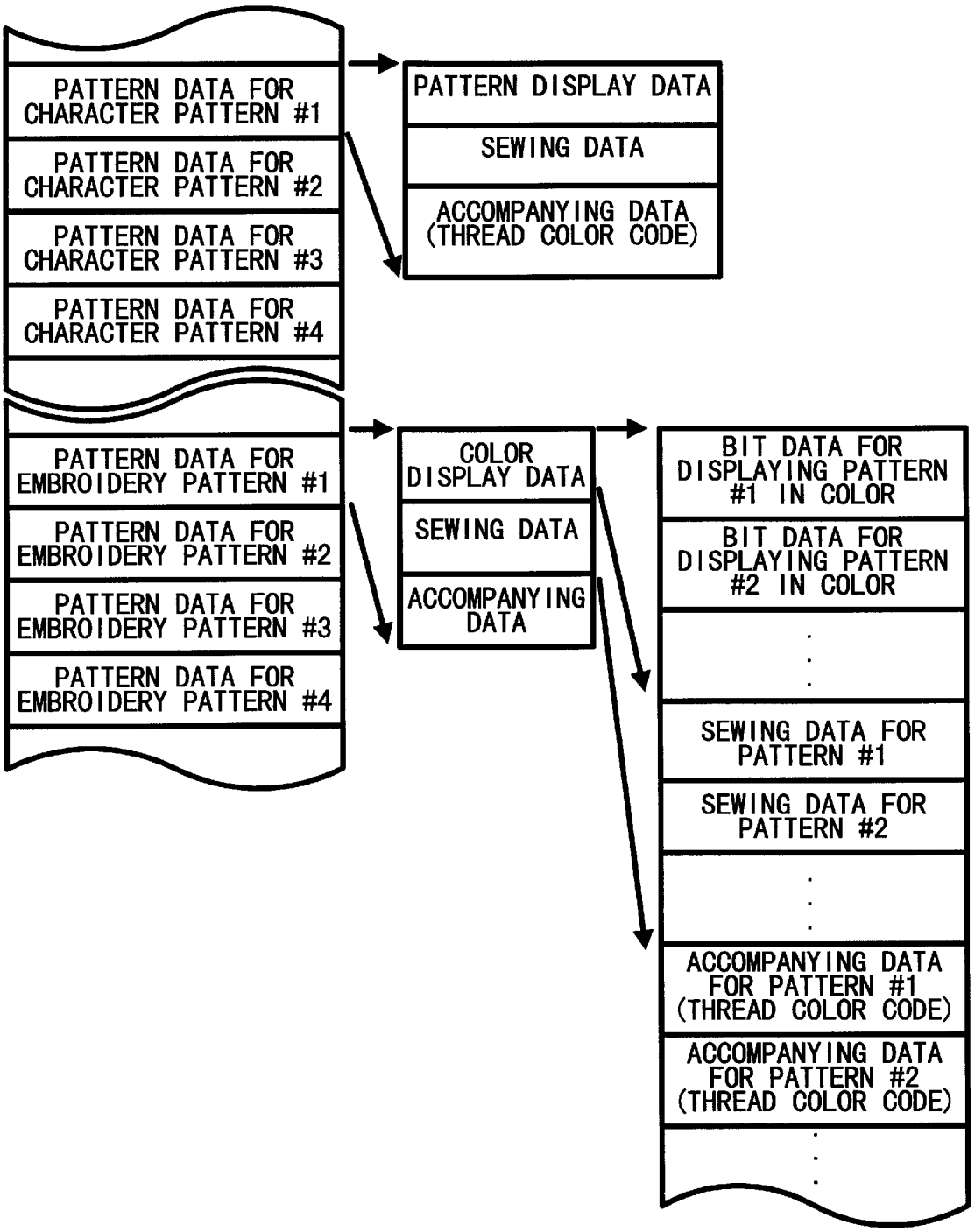
FIG. 3 is a diagram showing a structure of data stored in a ROM.

As shown in FIG. 3, a pattern data memory 23*a* of the ROM 23 stores pattern data of character patterns which are various kinds of embroidery patterns, such as numbers and alphabetic characters, (character pattern No. 1, character pattern No. 2, character pattern No. 3. . . ) and are divided into groups by font type. Further, the pattern data memory 23*a* stores pattern data of picture patterns which are various kinds of embroidery patterns, such as animals, flowers, and frames (picture pattern No. 1, picture pattern No. 2, picture pattern No. 3. . . ) and are divided into groups by picture type.

Each pattern data of the character pattern and the picture (embroidery) pattern includes color display data constructed of color bit data for displaying the pattern in color, sewing data constructed of a plurality of stitch data, and accompanying data including thread color data (thread color code).

In the pattern data of each picture pattern, such as animals and flowers, pattern display data is constructed of bit data of a plurality of patterns for constructing the embroidery pattern (pattern No. 1, pattern No. 2, pattern No. 3. . . ), the sewing data is constructed of sewing data of the plurality of patterns, and the accompanying data is constructed of accompanying data of the patterns (thread color code). A stop code SC for stopping the sewing operation to change the thread when the pattern is finished sewing is additionally stored in the last of the sewing data of each pattern.

A plurality of ROM cards 40 are prepared for the electronically-controlled sewing machine M. The ROM 41 of each ROM card 40 stores pattern data for various kinds of embroidery patterns (embroidery pattern No. 1, embroidery pattern No. 2, embroidery pattern No. 3. . . ), with substantially the same structure as the ROM 23. The ROM 23 built-into the machine and the ROM 4 of the ROM card 40 correspond to a pattern data storing device. The pattern data of the embroidery patterns may be stored in the FD 45 so that embroidery patterns from the FD 45 can also be selected or edited.

The ROM 23 stores a pattern selection routine, a pattern data reading routine, a subtractive color display data generating routine, a memory control routine, a display control routine, and a display data generation memory control program. The pattern selection routine can select a desired embroidery pattern from the various kinds of embroidery patterns. The pattern data reading routine reads the pattern data selected by the pattern selection control. The subtractive color display data generating routine generates black-and-white data by performing a color subtraction process on the color display data read by the reading control of the pattern data. The memory control routine stores the black-and-white data of the embroidery pattern generated by the control of the subtractive color display data generation in the flash memory 25 which is capable of using rewritable data. The display control routine displays the embroidery pattern in black and white based on the black-and-white data stored in the flash memory 25. The display data generation memory control program includes a color display data generating routine which is capable of generating the color display data using the sewing data of the embroidery pattern and the accompanying data.

In addition to the control programs described above, the ROM 23 also stores general control programs for controlling the display of and the sewing operation of utility stitch patterns and control programs for controlling the driving of the motors 17, 18, 19 based on the sewing data and the sewing operation of the embroidery pattern.

Next, the controls, including the display data generation memory control executed in the controller C, will be described with reference to the flowcharts of FIGS. 4 through 6. As shown in FIGS. 9 through 12, an example of selecting and editing a picture (animal) pattern "bear", a picture (frame) pattern "heart", and a character pattern "HAND MADE" will be described. Si (i=1, 2, 3 . . . ) stands for a step in the flowcharts.

Figure 4:
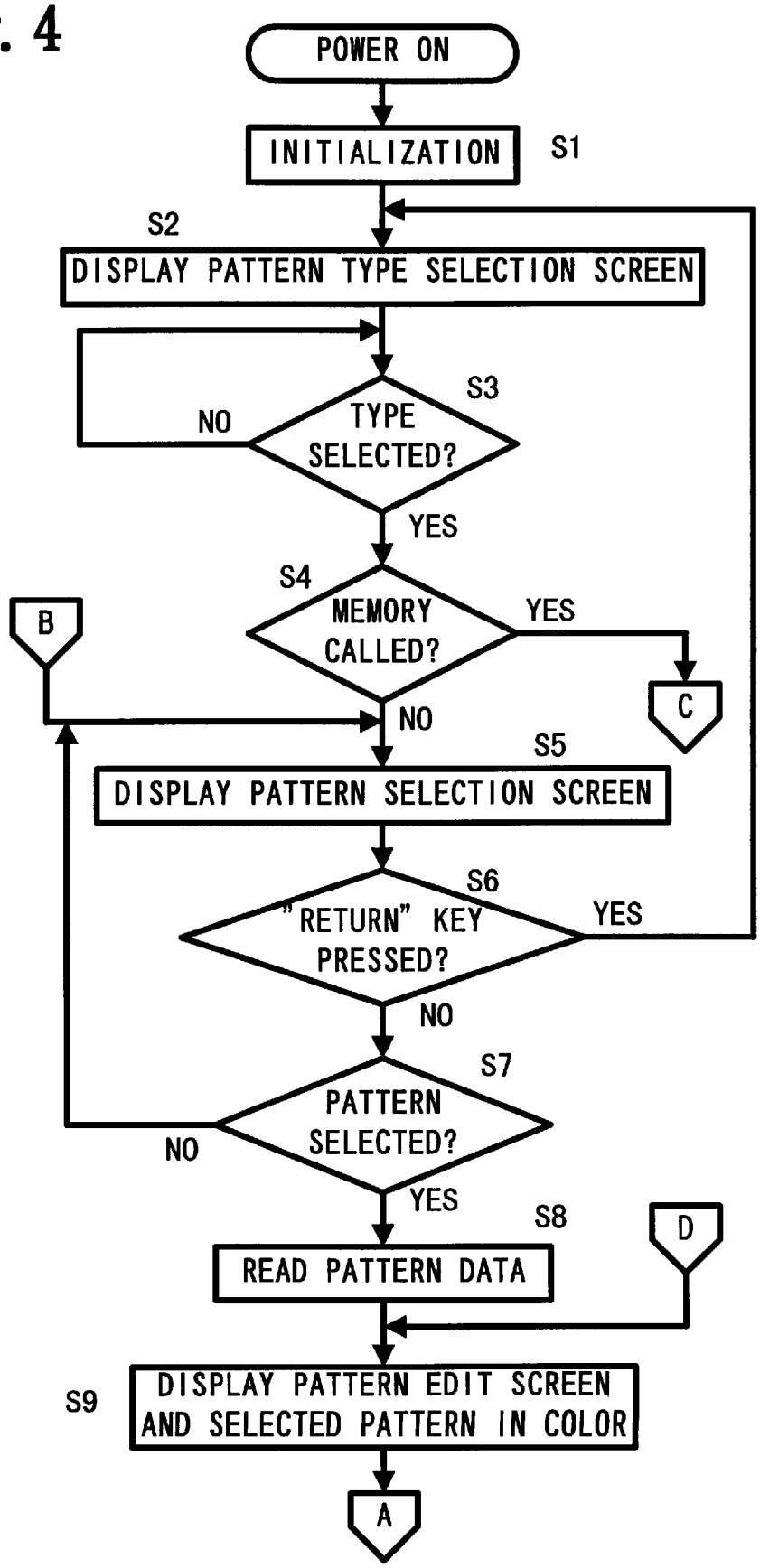
FIG. 4 is a flowchart of a main routine executed in the sewing machine.
Figure 7:
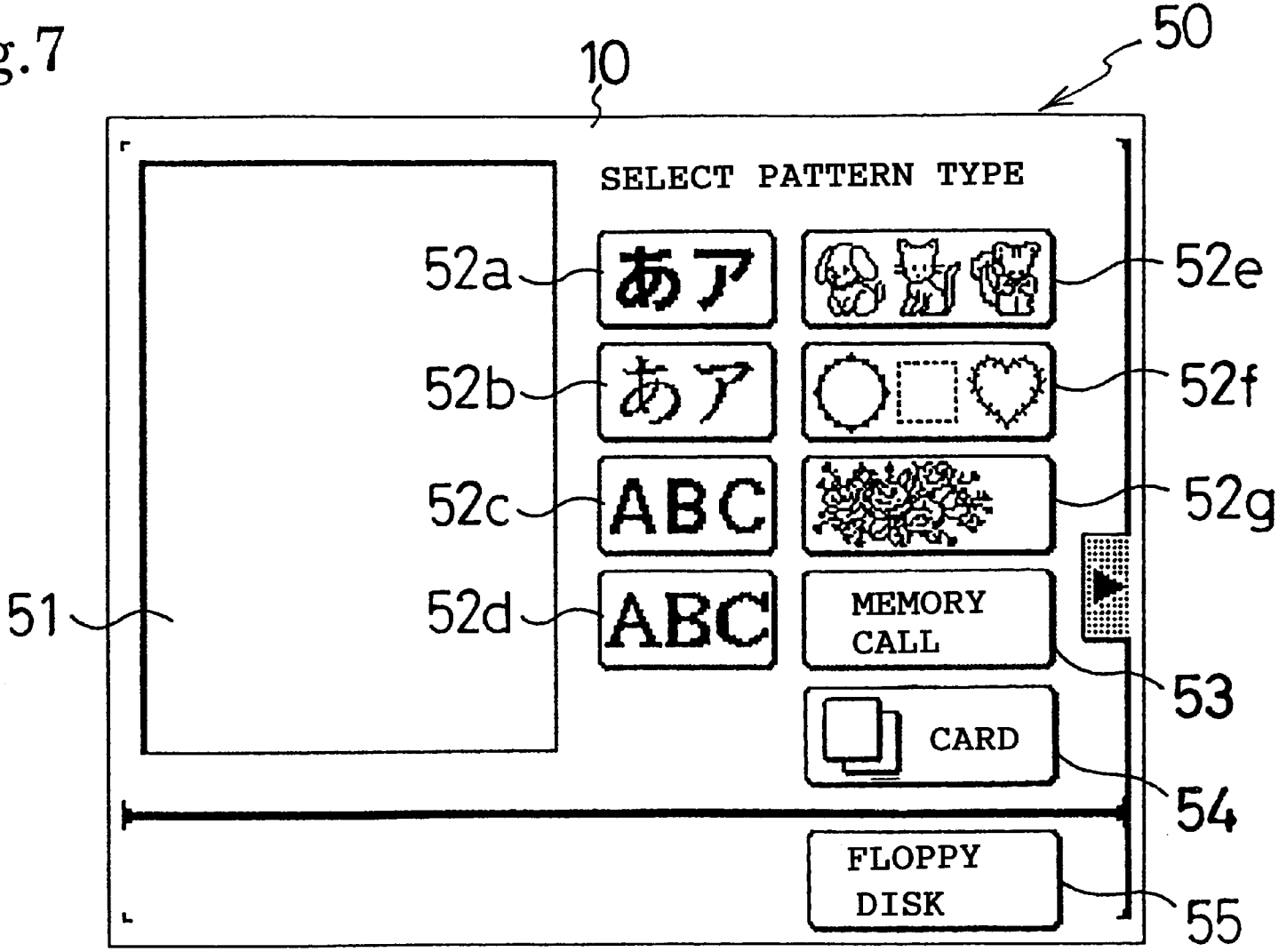
FIG. 7 shows an example of a pattern type selection screen displayed on a display.

As shown in FIG. 4, when the power is turned on and the control is started, initialization, such as clearing each memory in the RAM 24, is performed (S1). After that, a pattern type selection screen 50 (FIG. 7), where a type of an embroidery pattern is selected, appears on the display 10 (S2).

The pattern type selection screen 50 is provided with a pattern display area 51, corresponding to the embroidery frame, at the left side of the screen 50. On the right side of the pattern display area 51, there are a plurality of pattern type selection keys 52*a* through 52*g* for selecting the type of embroidery pattern (character patterns and picture patterns including animal patterns, frame patterns, and flower patterns) stored in the ROM 23, a "MEMORY CALL" key 53 for selecting an embroidery pattern stored in the flash memory 25, a "CARD" key 54 for selecting an embroidery pattern stored in the ROM card 40, and a "FLOPPY DISK" key for selecting an embroidery pattern stored in the FD 45.

Any one of the pattern type selection keys 52*a* through 52*g*, the "MEMORY CALL" key 53, the "CARD" key 54 or the "FLOPPY DISK" key 55 can be pressed and, thus, the type of the embroidery pattern is selected (S3:Yes). When any key except the "MEMORY CALL" key 53 is pressed (S4:No), a pattern selection screen 60 appears on the display 10.

Figure 8:
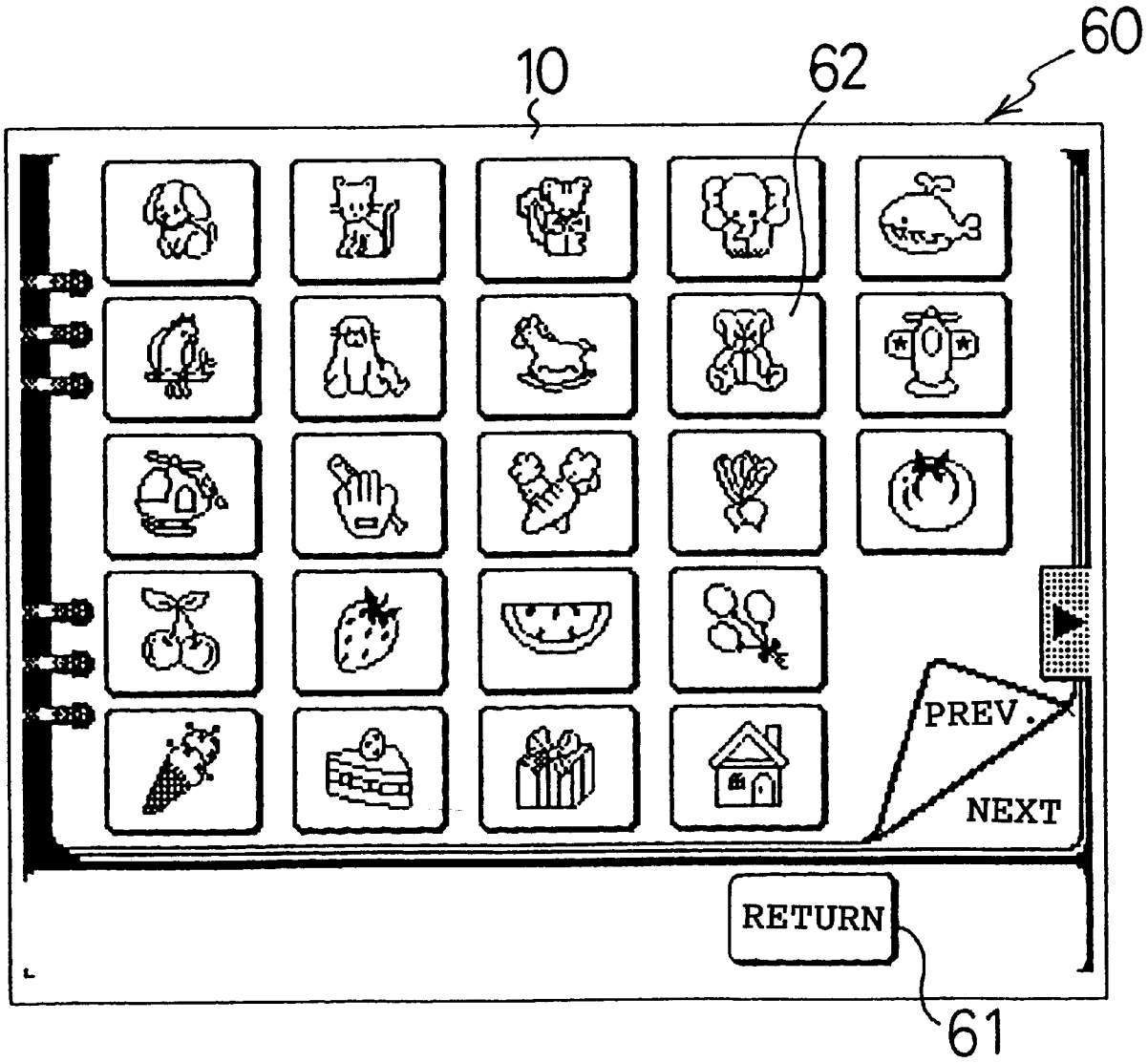
FIG. 8 shows an example of a pattern selection screen displayed on the display.

For example, when a picture pattern "bear" is to be selected, the pattern type selection key 52*e* is pressed, and thus the pattern selection screen 60 of FIG. 8 appears. In the pattern selection screen 60, when the "RETURN" key 51 is pressed (S6:Yes), the flow returns to S2 and the pattern type selection screen 50 of FIG. 7 appears. When the "RETURN" key is not pressed (S6:No), and a bear pattern selection key 62 is pressed and the pattern is selected (S7:Yes), the pattern data of the embroidery pattern is read from the ROM 23 (S8). At S9, a pattern edit screen 70 of FIG. 9 appears. The selected embroidery pattern "bear" 72 is then displayed on the display 10 in color based on the color display data.

The pattern edit screen 70 (FIG. 9) is provided with a pattern display area 71 on the left side. The embroidery pattern "bear" 72 is displayed within the pattern display area 71 in color. On the right side of the pattern display area 71, eight directional arrow keys 73 are provided. On the bottom of the eight directional arrow keys 73, there are a "DELETE" key 74, a "WHICH PATTERN?" key 75, a "MEMORY" key 76, a "GRID" key 77, and a "RETURN" key 78.

Figure 5:
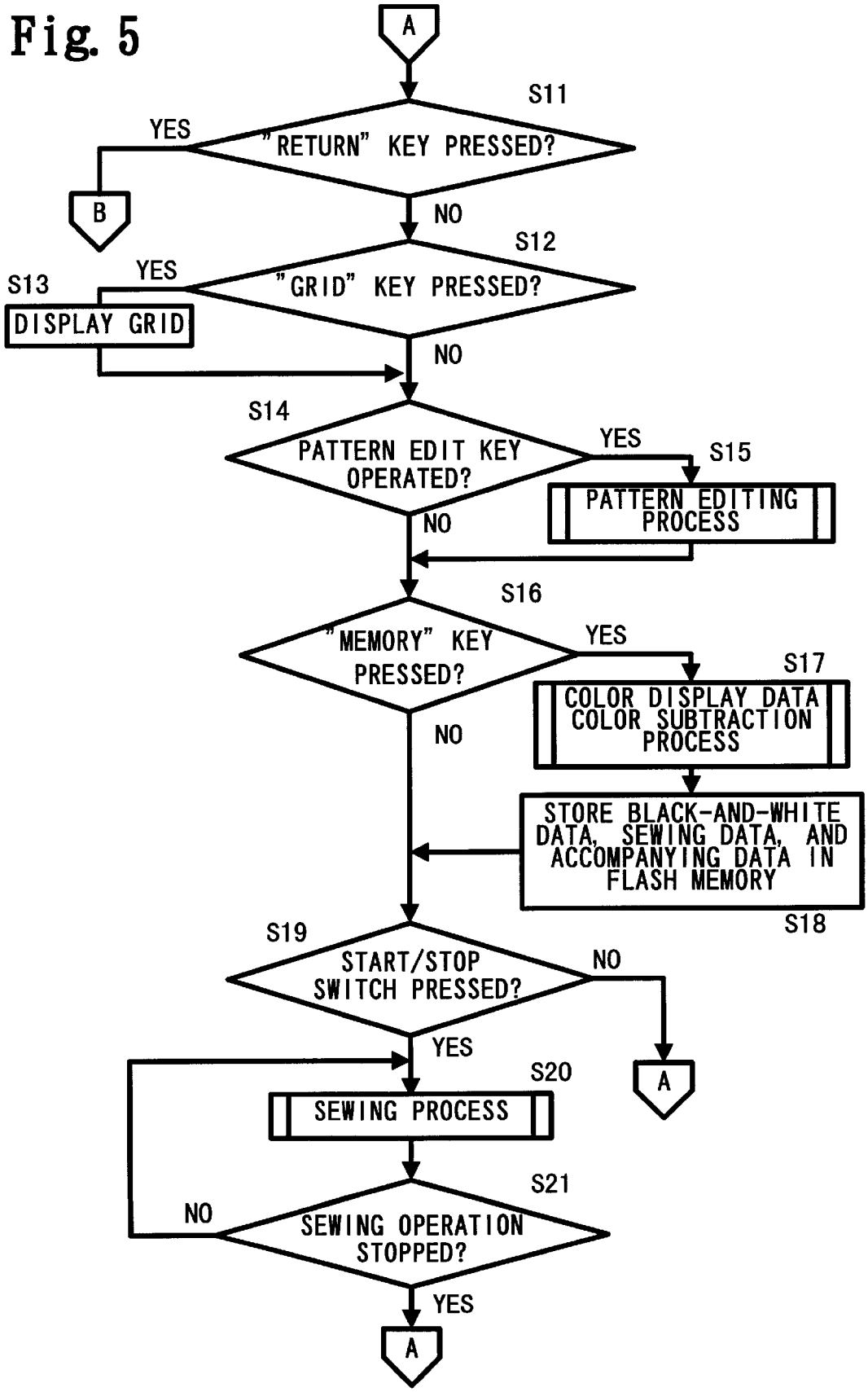
FIG. 5 is a flowchart of a main routine executed in the sewing machine.
Figure 9:
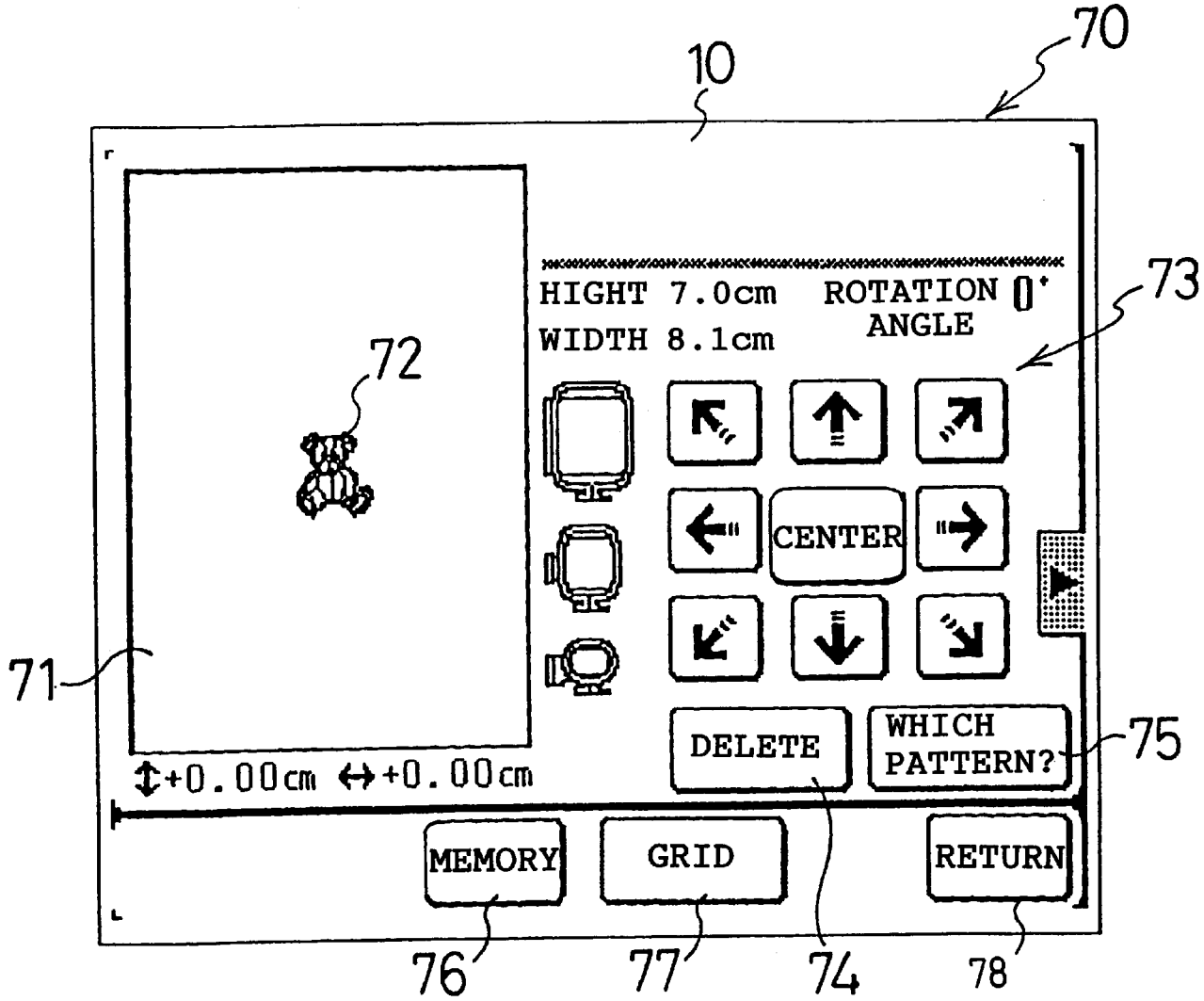
FIG. 9 shows an example of a pattern edit screen displayed on the display.
Figure 10:
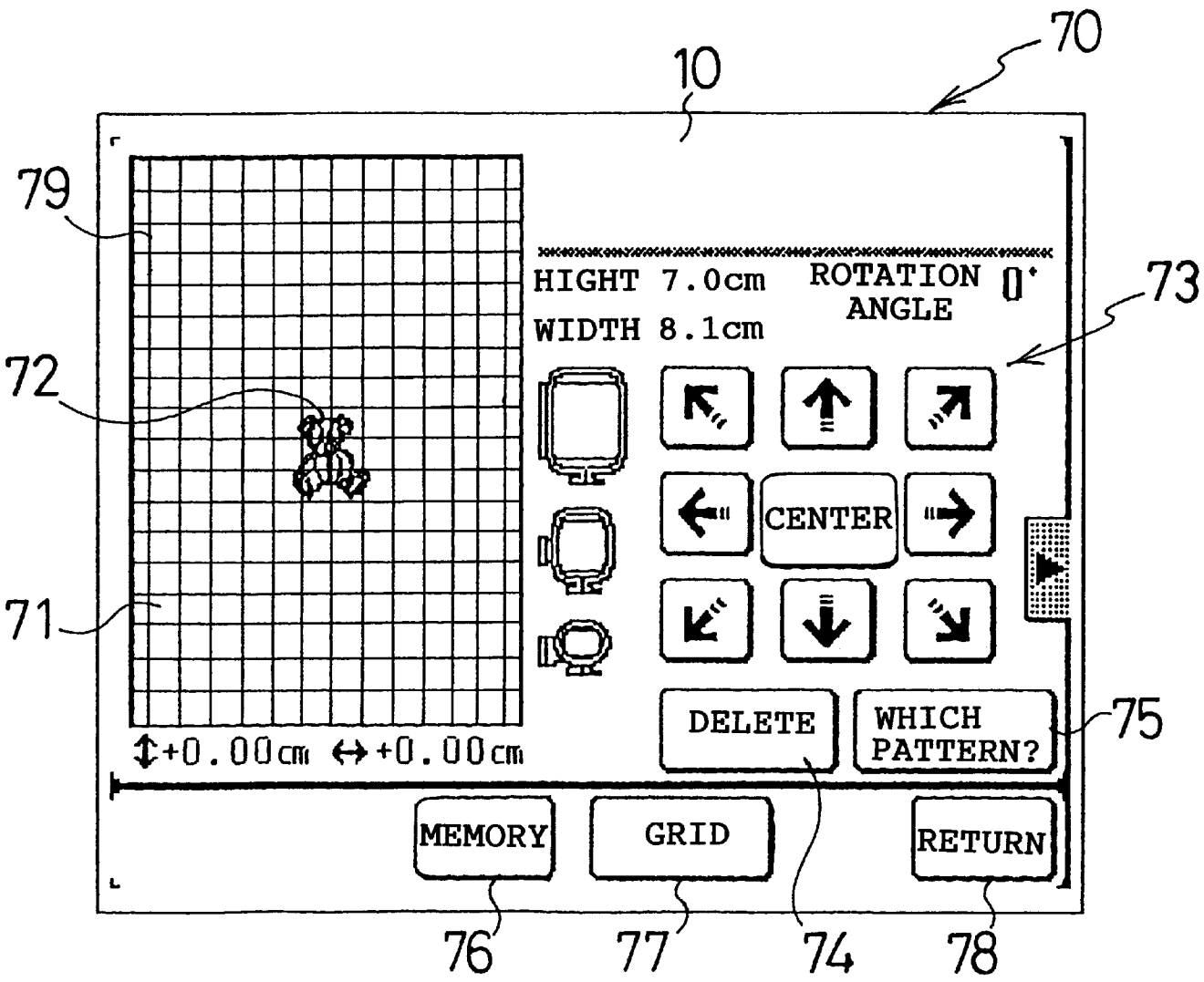
FIG. 10 shows an example of the pattern edit screen displayed on the display.

Next, as shown in FIG. 5, when the "RETURN" key 78 is pressed on the pattern edit screen 70 of FIG. 9 (S11:Yes), the flow returns to S5, and thus the pattern selection screen 70 of FIG. 8, which is the previous screen, appears on the display 10. When the "RETURN" key 78 is not pressed (S11:No) and the "GRID" key 77 is pressed (S12:Yes), a grid 79 which is constructed of a plurality of equidistant vertical and horizontal lines (FIG. 10) appears in the pattern display area 71 (S13). Therefore, it becomes easy to recognize and change the arrangement of the pattern.

Next, when a pattern edit key is pressed (S14:Yes), a pattern editing process (S15) is performed. In the pattern editing process, the arrangement of the picture pattern "bear" 72 can be changed by touching the eight directional arrow keys 73. Further, not shown in the drawings, the embroidery pattern can be enlarged, reduced or rotated by predetermined key operations. In a state where a plurality of embroidery patterns are displayed (selected), such as the "bear", "heart" and "HAND MADE" of FIG. 11, when one of the embroidery patterns is specified by touching the "WHICH PATTERN?" key 75 sequentially, the thus specified embroidery pattern is highlighted and can be edited. Further, the specified embroidery pattern can be deleted by pressing the "DELETE" key 74.

Then, when the "MEMORY" key 76 is not pressed (S16:No), but the start/stop switch 12 is pressed (S19:Yes), the sewing process of the embroidery pattern selected at S7 (S20) is performed. When the sewing operation is stopped (S21 :Yes), the flow returns to S11. In order to select and edit the picture patterns "bear" and "heart" and the character pattern "HAND MADE", the "RETURN" key 78 is pressed to return to the pattern selection screen 60 of FIG. 8 from the pattern edit screen 70 of FIGS. 9 or 10. Further, the "RETURN" key 61 is pressed to return to the pattern type selection screen 50 of FIG. 7 on the pattern selection screen of FIG. 8. By performing substantially the same procedure as described above, the picture pattern "heart" and the character pattern "HAND MADE" are selected and edited.

Figure 11:
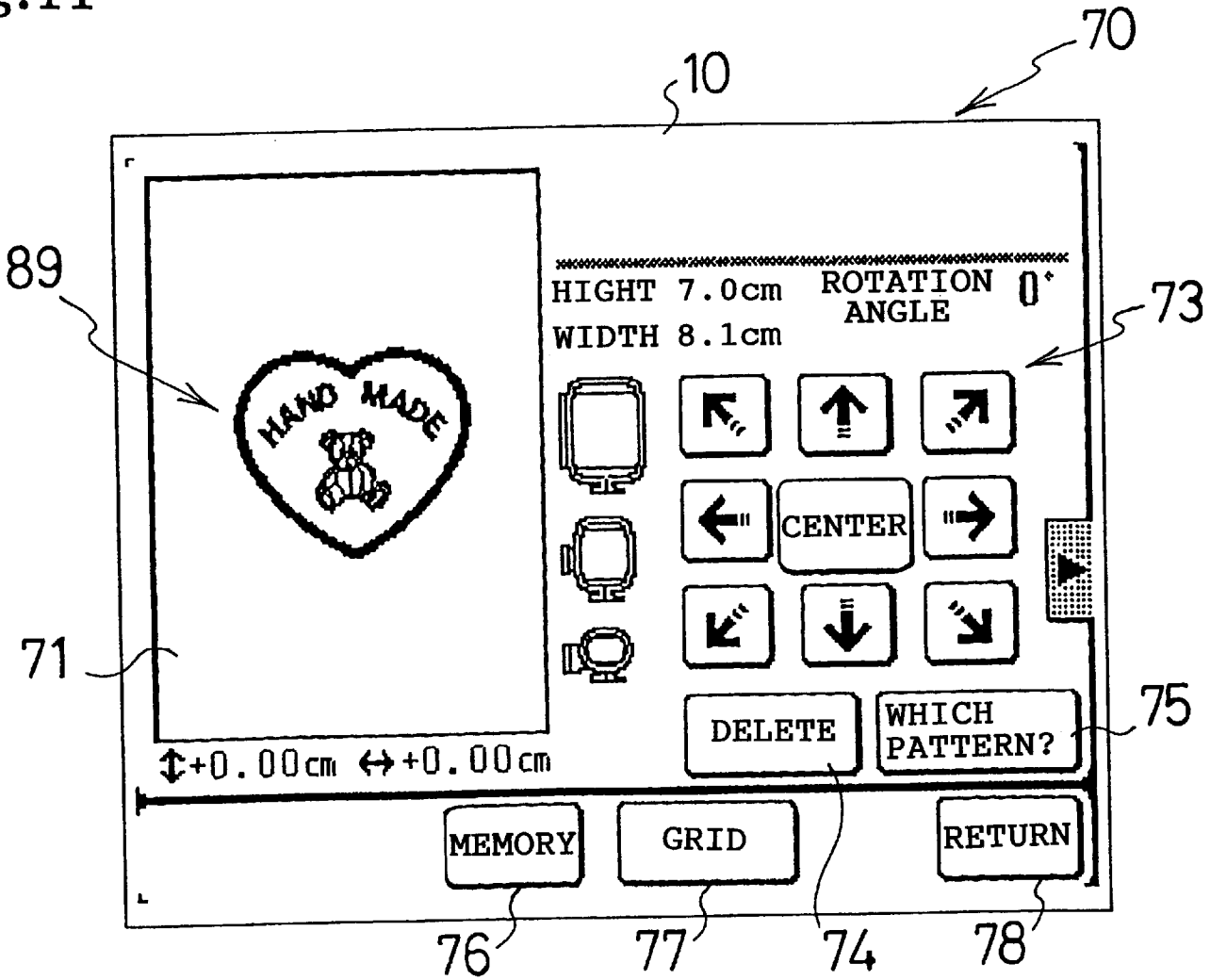
FIG. 11 shows an example of the pattern edit screen displayed on the display.
Figure 12:
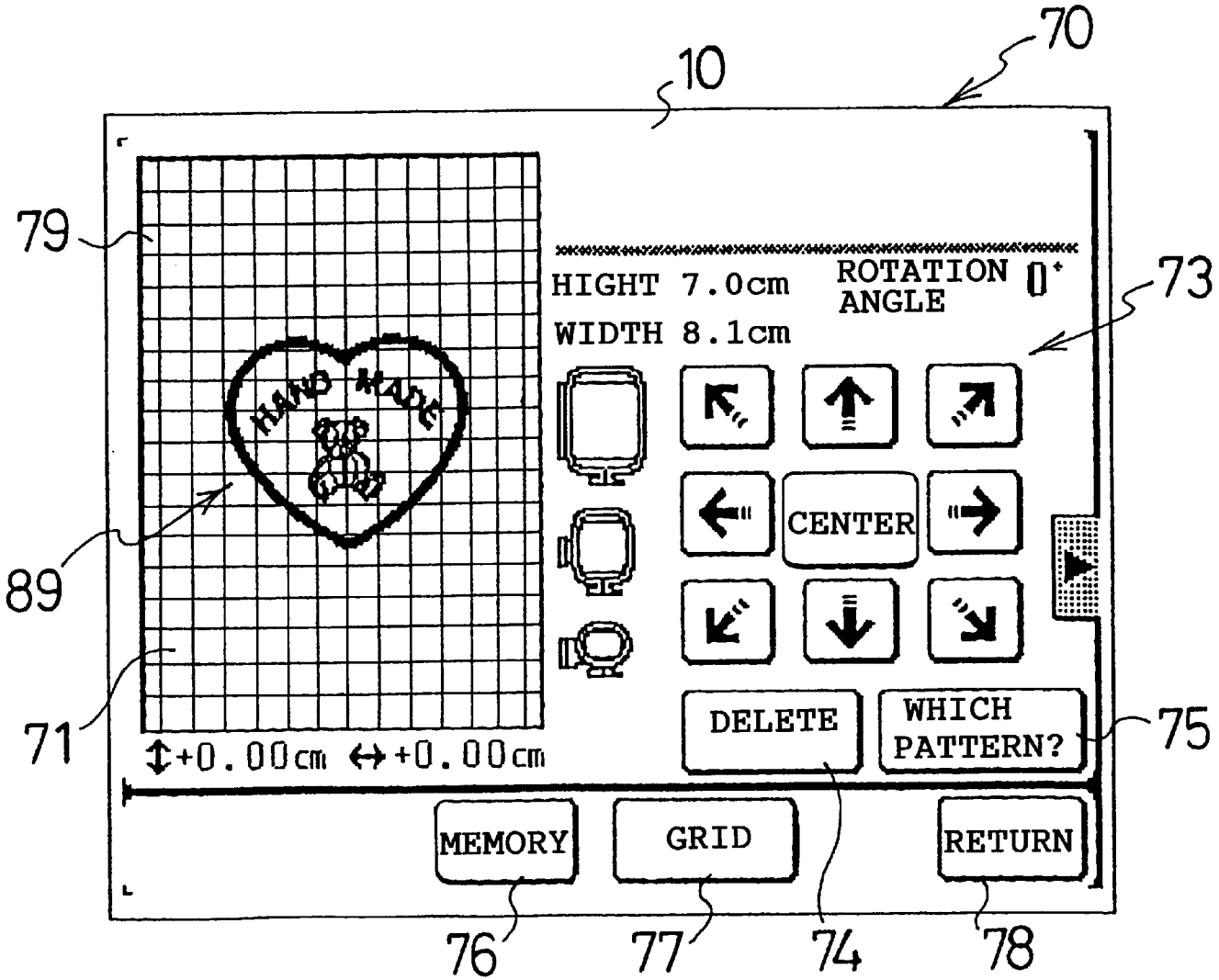
FIG. 12 shows an example of the pattern edit screen displayed on the display.

After the picture patterns "bear" and "heart" and the character pattern "HAND MADE" are selected and edited, an embroidery pattern 89 which is a combination of the patterns selected above is displayed in the pattern display area 71 on the pattern edit screen 70 of FIG. 11. When the "GRID" key is pressed here, as shown in FIG. 12, the grid 79 can be displayed in the pattern display area 71 displaying the embroidery pattern 89. Therefore, a relative relationship of the arrangement of the patterns "bear", "heart", and "HAND MADE" can be easily observed, so that the arrangement of these patterns can be easily changed.

As shown in FIG. 5, when the "MEMORY" key 76 is pressed on the pattern edit screen 70 of FIGS. 11 or 12 (S16:Yes), a color display data color subtraction process (S17) is performed. In the color display data color subtraction process, the color subtraction process is performed on the color display data of the picture patterns "bear" and "heart" and the character pattern "HAND MADE", and thus black-and-white display data is generated.

The color subtraction process will be described in detail. For example, when it is possible to express 256 colors on the color display, one byte of the color display data are needed for one dot of the display. When it is possible to express 640 million colors on the display, two bytes of color display data are needed for one dot of the display.

In the color subtraction process, the display data which corresponds to each dot on the display is subtracted of its colors, following a predetermined procedure, based on the color display data. When the black-and-white display data are generated, the data are generated as binary data to make one dot "ON" or "OFF" on the display (i.e. the data is determined as "1" or "0"). All dots of a pattern are stored as "ON" and also each pattern is stored while corresponding each pattern to the accompanying data including the thread color data.

Figure 15:
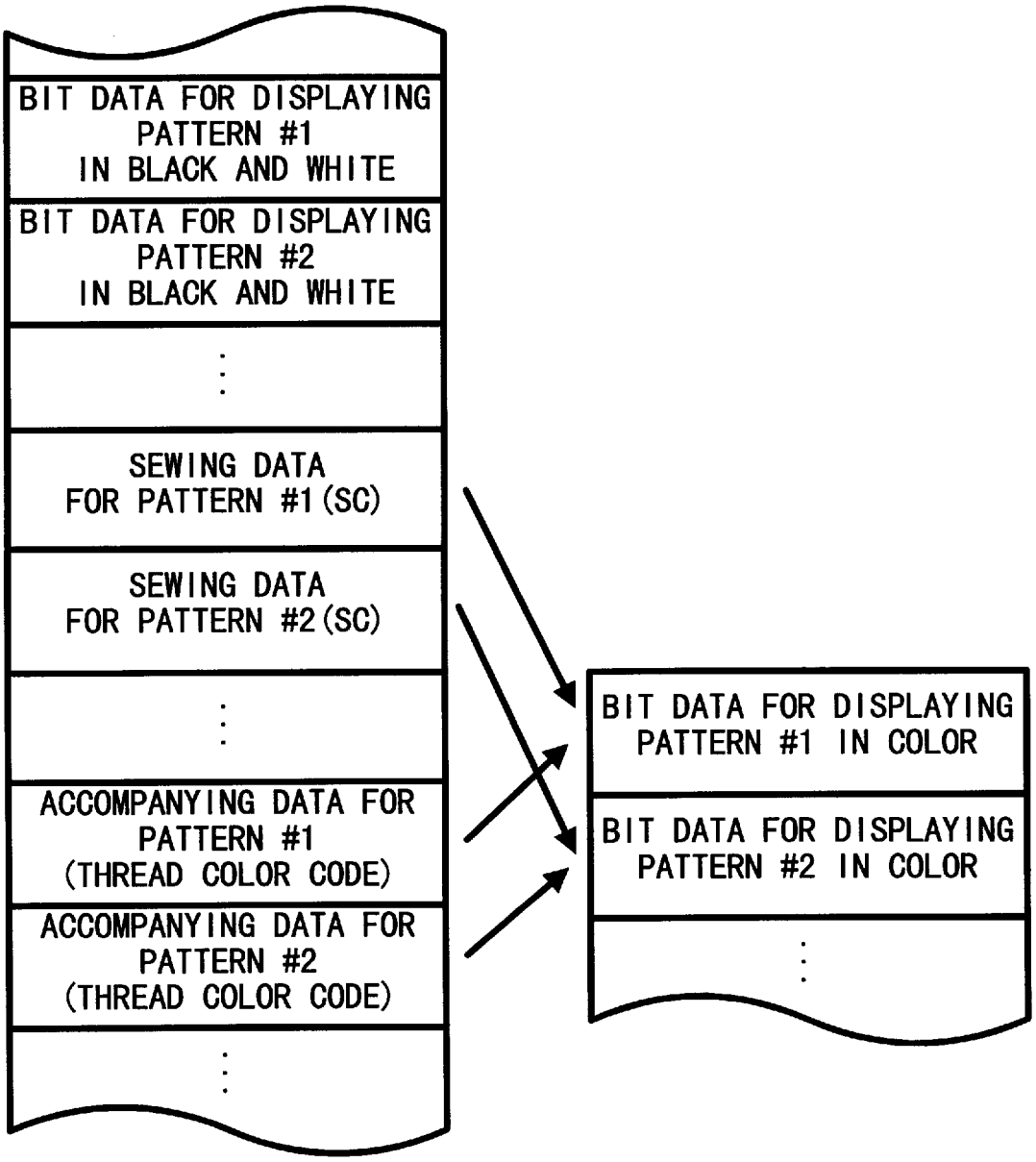
FIG. 15 is a diagram showing a structure of data stored in a ROM and a flash memory.

Then, the black-and-white data of the picture patterns "bear" and "heart" and the character pattern "HAND MADE" generated in the color display data color subtraction process, the sewing data, and the accompanying data are stored in the flash memory 25. When the picture pattern "bear" is constructed of a plurality of color patterns (pattern No. 1, pattern No. 2. . . ), as shown in FIG. 15, the color display data color subtraction process is performed for each pattern, and the generated black-andwhite data, the sewing data, and the accompany data are stored in the flash memory 25.

Figure 6:
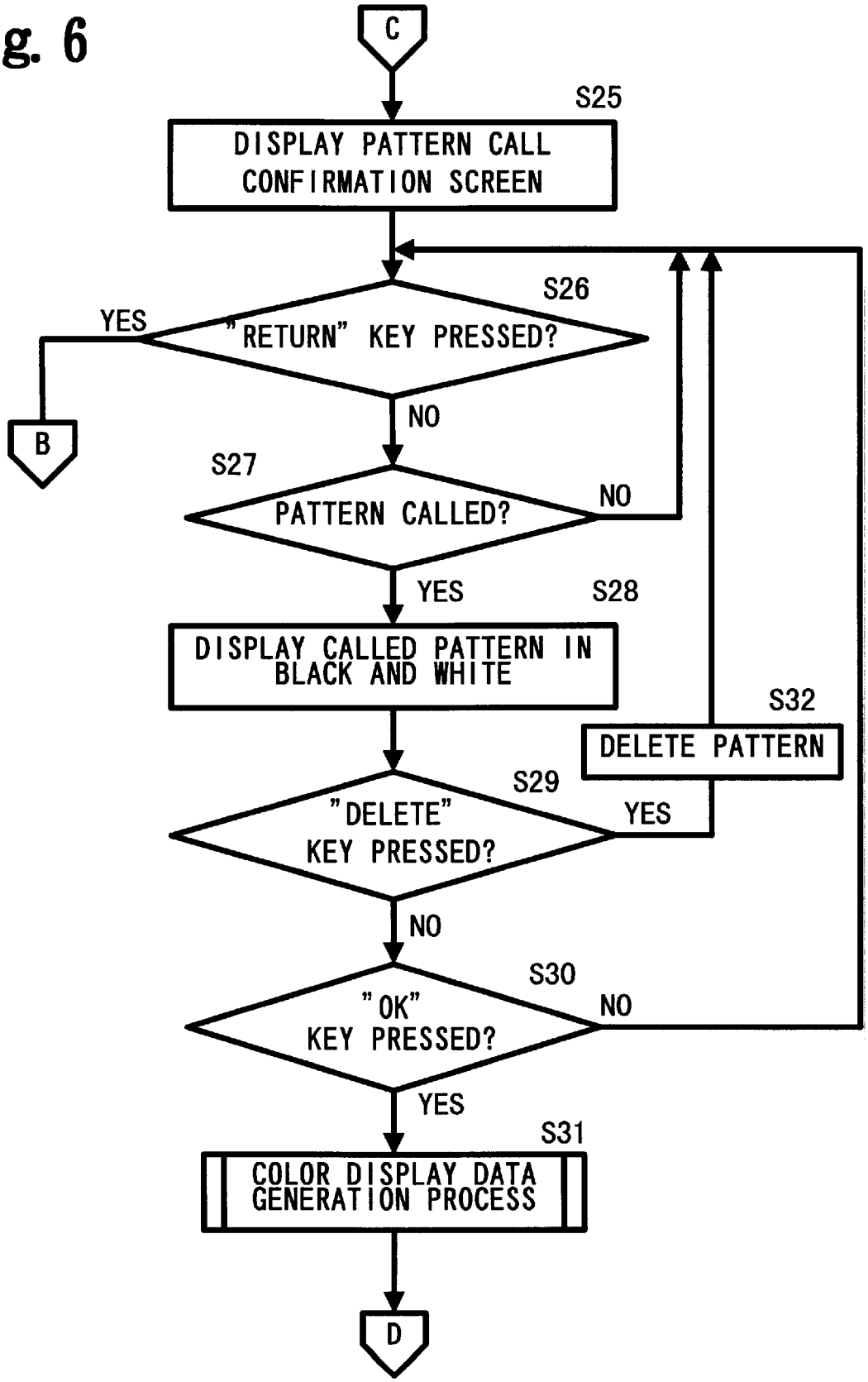
FIG. 6 is a flowchart showing the control executed in the controller.
Figure 13:
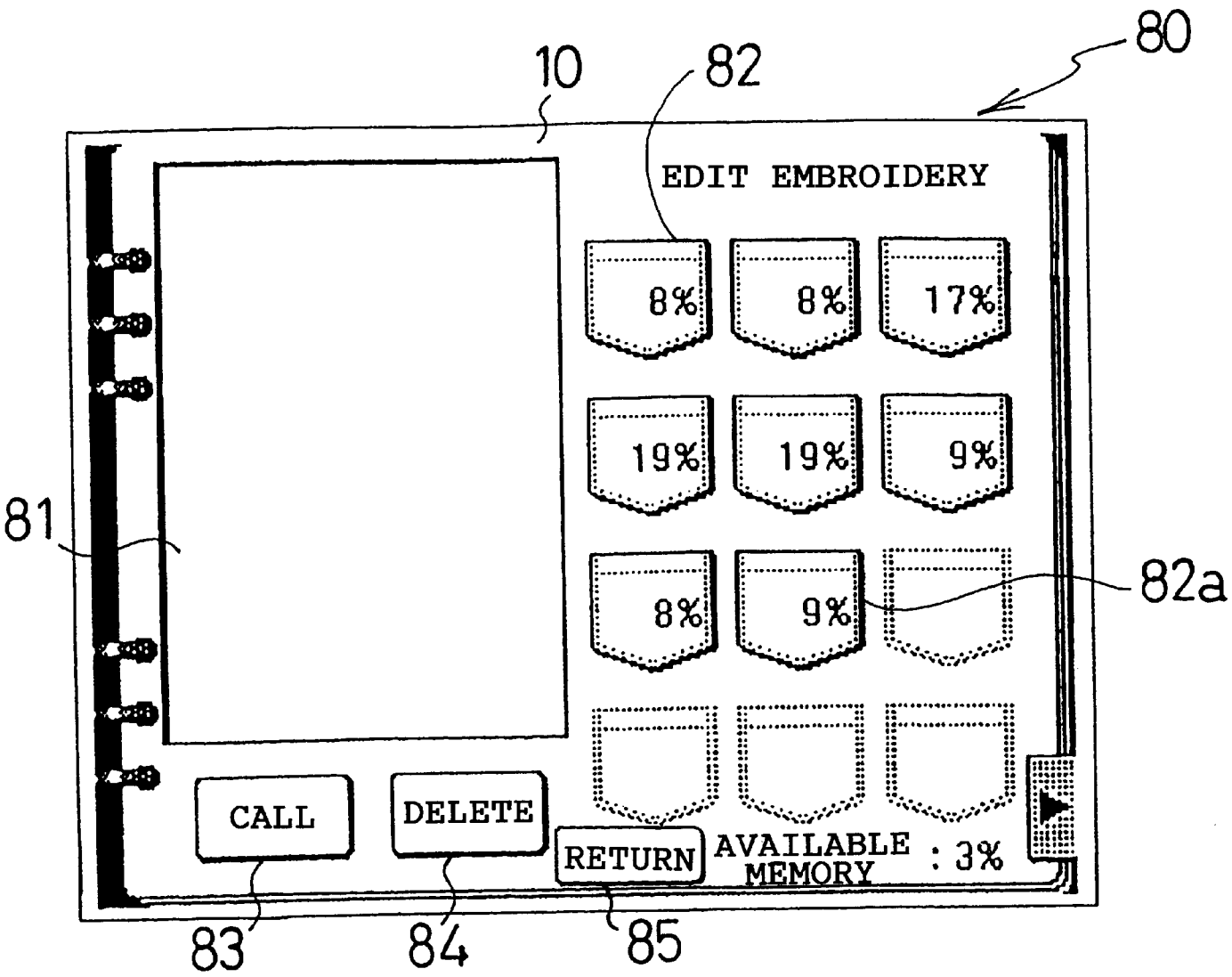
FIG. 13 shows an example of a pattern call confirmation screen displayed on the display.
Figure 14:
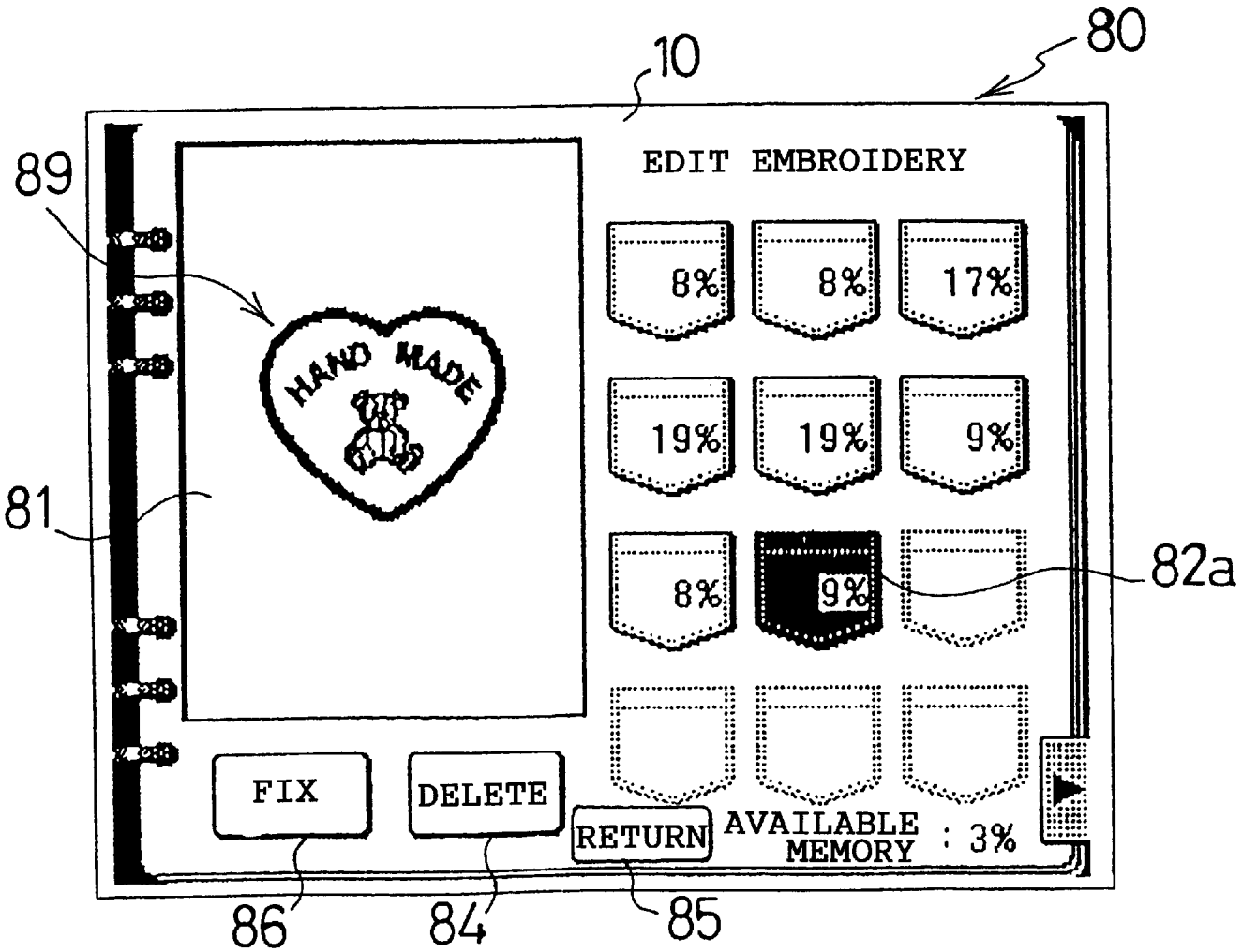
FIG. 14 shows an example of the pattern call confirmation screen displayed on the display.

Next, as shown in FIG. 4, when the "MEMORY CALL" key 53 is pressed (S4:Yes) on the pattern type selection screen 50 while the black-and-white data of the embroidery pattern 89 constructed of the patterns "bear", "heart" and "HAND MADE", the sewing data and the accompanying data are stored in the flash memory 25, a pattern call confirmation screen 80 of FIG. 13 is displayed on the display 10 (S25) as shown as FIG. 6.

The pattern call confirmation screen 80 is provided with a pattern display area 81 on its left area. On the right side of the pattern display area 81, a plurality of pocket keys 82 are provided. On the bottom of the pattern display area 81, there are a "CALL" key 83, a "DELETE" key 84 and a "RETURN" key 85. When the pocket keys 82 are displayed on the screen 80, a plurality of embroidery patterns are stored in the flash memory 25 in correspondence with the pocket keys 82. The parentage shown in the pocket key shows an amount of storage data for a pattern relative to the full storage capacity of the flash memory 25.

It is assumed that the black-and-white data of the embroidery pattern 89 constructed of the patterns "bear", "heart" and "HAND MADE", the sewing data, and the accompanying data are stored in the flash memory 25 in correspondence with the pocket key 82. When the "RETURN" key 85 is not pressed (S26:No), the pocket key 82*a* is pressed and then the "CALL" key 83 is pressed, the black-and-white data of the embroidery data 89 is called (S27:Yes) and the called embroidery pattern 89 is displayed on the pattern display area 81 in black and white based on the black-and-white data (S28).

When the embroidery pattern 89 is displayed on the pattern display area 81 in black and white, the "CALL" key 83 is changed to an "OK" key 86. When the "DELETE" key 84 is not pressed (S29:No) and the "OK" key 86 is pressed (S30:Yes), a color display data generating process (S31) is performed. In the color display data generating process, color display data is generated from the sewing data and the accompanying data of the embroidery pattern 89. Particularly, a thread color code of the pattern is included in the accompanying data stored in the flash memory 25, so that the color display data is generated based on the sewing data and color data directed by the thread color code. After that, the flow returns to S9, the pattern edit screen 70 of FIG. 9 appears on the display 10, and the embroidery pattern 89 is displayed on the display 10 in color based on the color display data generated in the color display data generating process at S31.

On the other hand, when the black-and-white data of the embroidery pattern 89 is not called because the pocket key 82 or the "CALL" key is not pressed (S27:No) and when the "OK" key 86 is not pressed (S30:No), the flow returns to S26. When the "DELETE" key is pressed (S29:Yes), the pattern data of the embroidery pattern 89 displayed on the display 10 in black and white is deleted from the flash memory 25 (S32). Then, the flow returns to S26.

According to the electronically-controlled sewing machine M, the subtractive color display data is generated by performing the color subtraction process on the color display data of the selected embroidery pattern, and the subtractive color display data is rewritably stored in the flash memory 25. Therefore, the flash memory 25 can store more pattern data of the embroidery patterns, compared with the case where the flash memory 25 stores the color display data whose data amount is large. That is, the storage capacity of the flash memory 25 can be made smaller, so that the manufacturing costs can be reduced.

By storing the sewing data and the accompanying data in the flash memory 25 with the subtractive color display data of the embroidery pattern, it becomes possible to set and sew one or a plurality of selected/edited pattern data as an embroidery pattern to be sewn without selecting/editing it again. Further, the black-and-white data is generated in the color display data color subtraction process, so that the data amount of the black-and-white data is much smaller than the data amount of the color display data. Accordingly, the storage capacity of the flash memory 25 capable of storing the black-and-white data can be smaller and the manufacturing costs can be reduced.

Further, the sewing data and the accompanying data including the thread color data of the embroidery pattern is stored in the flash memory 25 with the subtractive color display data of the embroidery pattern, and then the color display data is generated from the sewing data and accompanying data of the embroidery pattern. Therefore, when the embroidery data set in the flash memory 25 is determined as an embroidery pattern to be sewn, the color display data can be generated from the sewing data and the accompanying data of the embroidery pattern while the storage amount of the flash memory 25 is not increased by storing the color display data in the flash memory 25.

Modified embodiments of the aforementioned embodiment will be described.

In the aforementioned embodiment, all dots of a pattern are stored as "ON". However, ON/OFF of the dots may be performed according to a gradation pattern corresponding to each color. In each graduation pattern, for example, the ratio of ON to OFF of dots may be set as described below.

white 1:3, yellow 1:2, red 1:1, blue 2:1, black 1:0.

Therefore, the dot pattern in the yellow pattern should be such as, ON, OFF, OFF, ON, OFF, OFF . . . On the other hand, the dot pattern in the blue pattern is such as, ON, ON, OFF, ON, ON, OFF . . .

In this modification, the subtractive color display data can be used not only in a color display device but also in a monochrome display device.

Further, in the color display data color subtraction process, for a color which is expressed by two bytes of data for one dot (640 thousand colors of color display data), one byte (256 colors) or some bits (several colors or several tens of colors) of color display data may be generated by performing a predetermined color conversion process. In the color conversion process, the 1st to 2500th colors of 640 thousand colors correspond to the 1st color of 256 colors, the 2501st to 5000th colors of 640 thousand colors correspond to the 2nd color of 256 colors. In this manner, the predetermined number of colors correspond to the different predetermined numbers of colors.

The pattern selection routine, the pattern data reading routine, the subtractive data generating routine, the memory control routine, and the display data generating memory control program, including the color display data generating routine of the main embodiment, may be recorded in the ROM card 7 or the FD 8 which is a recording medium. Therefore, the ROM card 7 or the FD 8 can be inserted into not only the electronically-controlled sewing machine M but also a sewing machine which has a display and on which the ROM card or the FD can be used, whereby the pattern display program recorded in the ROM card or the FD can be used. The same actions and effects that are obtained in the electronically-controlled sewing machine M of the embodiment can be obtained in the sewing machine with which the pattern display program is used.

In the aforementioned embodiment, the color display data for displaying various kinds of embroidery patterns in color, the sewing data, and the pattern data including the accompanying data are stored in the ROM 23. However, the pattern data constructed of the sewing data regarding the various kinds of the embroidery data and the accompanying data including the thread color data of the embroidery pattern may be stored in the ROM 23, the color display data may be generated from the subtractive color data of the selected embroidery pattern and the accompanying data, and the embroidery data may be displayed on the display 10 in color based on the color display data.

Further, in this case, the subtractive color display data may be generated by performing the color subtraction process on the color display data, and the subtractive color display data may be stored in the flash memory 25 to be rewritable of the data therein. Further, it is possible to generate the black-and-white data instead of the subtractive color display data. Furthermore, the color display data may be generated again from the sewing data (or subtractive color data) stored in the flash memory 25 and the accompanying data.

That is, it is possible to store the pattern data of a plurality of embroidery patterns in the ROM 23, compared with the case of storing the color display data in the ROM 23. Likewise, it is possible to store the pattern data of a plurality of embroidery patterns in the flash memory 25, compared with the case of storing the color display data in the flash memory 25. Therefore, the storage capacities of the ROM 23, which is a pattern data storing medium, and the flash memory 25, which is a nonvolatile storing medium, can be made smaller, so that the manufacturing costs can be reduced.

While the invention has been described in detail with reference to specific embodiments thereof, it would be apparent to those skilled in the art that various changes and modifications may be made therein without departing from the spirit of the invention.

What is claimed is:

1. A sewing machine for sewing a pattern on a work cloth, comprising:

a pattern data reading device that reads pattern data including color display data and sewing data from a pattern data storing device;

a display device including a color display that displays the pattern based on the color display data read by the pattern data reading device;

a pattern selecting device that selects a pattern;

a color subtracting device that subtracts colors included in the display data for the selected pattern and generates subtractive color display data;

a pattern data writing device that writes the subtractive color display data into a non-volatile storing medium; and a display controller that controls the display device to display a subtractive color pattern based on the subtractive color display data stored in the non-volatile storing medium.

2. The sewing machine according to claim 1, further comprising an edit device that edits the pattern selected by the pattern selecting device, wherein the color subtracting device generates the subtractive color display data based on the pattern edited by the edit device.

3. The sewing machine according to claim 1, wherein the color subtracting device generates a monochrome display data.

4. The sewing machine according to claim 1, wherein the pattern data writing device further writes sewing data and thread color data into the non-volatile storing device, the sewing apparatus further comprising a color display data generating device that generates a color display data based on the sewing data and the thread color data.

5. The sewing machine according to claim 1, wherein the pattern data writing device further writes sewing data and thread color data into the non-volatile storing device, the sewing apparatus further comprising a color display data generating device that generates a color display data based on the subtractive color data and the thread color data.

6. The sewing machine according to claim 1, further comprising a nonvolatile storing medium therein.

7. A sewing machine capable of sewing on a work cloth, comprising:

a pattern data reading device that reads pattern data including sewing data and thread color data from a pattern data storing device;

a color display data generating device that generates a color display data based on the sewing data and the thread color data read by the pattern data reading device;

a display device including a color display that displays the pattern based on the color display data generated by the color display data generating device;

a pattern selecting device that selects a pattern to be sewn;

a color subtracting device that subtracts colors included in the color display data for the selected pattern and generates a subtractive color display data;

a pattern data writing device that writes the subtractive color display data into a non-volatile storing medium; and a display controller that controls the display device to display a subtractive color pattern based on the subtractive color display data stored in the non-volatile storing medium.

8. The sewing machine according to claim 7, further comprising an edit device that edits the pattern selected by the pattern selecting device, wherein the color subtracting device generates the subtractive color display data based on the pattern edited by the edit device.

9. The sewing machine according to claim 7, wherein the color subtracting device generates a monochrome display data.

10. The sewing machine according to claim 7, wherein the pattern data writing device further writes thread color data into the non-volatile storing device, the sewing apparatus further comprising a color display data generating device that generates a color display data based on the sewing data and the thread color data.

11. The sewing machine according to claim 7, further comprises a non-volatile storing medium therein.

12. A method of reducing pattern data for colored patterns to be sewn by a sewing machine having a non-volatile operating memory and a color display device, comprising:

selecting a pattern for sewing from a selection screen displayed on the color display device;

displaying the selected pattern on the color display device;

instructing storage of the selected pattern in the non-volatile operating memory;

executing a color subtraction process to convert pattern colors to a single color with associated data; and storing the single color pattern and associated data in the non-volatile operating memory.

13. The method according to claim 12, further comprising:

calling for a display of patterns stored in the non-volatile operating memory;

selecting one of the stored patterns; and displaying the selected stored pattern in the single color.

14. The method according to claim 13, further comprising:

designating the displayed selected stored pattern as acceptable for sewing; and converting the displayed selected stored pattern to color using the associated data and displaying the selected stored pattern in color.

15. The method according to claim 13, further comprising deleting the displayed selected stored pattern from the non-volatile operating memory based on the single color pattern display.

16. The method according to claim 13, further comprising:

placing a grid over the displayed selected pattern after the displaying step; and editing the displayed selected pattern.

17. The method according to claim 14, further comprising one of instructing sewing of the color displayed selected stored pattern and deleting the color displayed selected stored pattern from the non-volatile operating memory.

18. A storage medium containing programs for reducing pattern data for colored patterns to be sewn by an embroidery machine having a non-volatile operating memory and a color display device, comprising:

a program for displaying a pattern selection screen;

a program for selecting a pattern for sewing from the pattern selection screen displayed on the color display device;

a program for displaying the selected pattern on the color display device;

a program for instructing storage of the selected pattern in the non-volatile operating memory;

a program for executing a color subtraction process to convert pattern colors to a single color with associated data; and a program for storing the single color pattern and associated data in the non-volatile operating memory.

19. The storage medium according to claim 18, further comprising:

a program for calling for a display of patterns stored in the non-volatile operating memory;

a program for selecting one of the stored patterns; and a program for displaying the selected stored pattern in the single color.

20. The storage medium according to claim 19, further comprising:

a program for designating the displayed selected stored pattern as acceptable for sewing; and a program for converting the displayed selected stored pattern to color using the associated data and displaying the selected stored pattern in color.

21. The storage medium according to claim 19, further comprising a program for deleting the displayed selected stored pattern from the non-volatile operating memory based on the single color pattern display.

22. The storage medium according to claim 19, further comprising:

a program for placing a grid over the displayed selected pattern after executing the program for displaying the selected stored pattern; and a program for editing the displayed selected pattern.

23. The method according to claim 20, further comprising a program for executing one of sewing of the color displayed selected stored pattern and deleting the color displayed selected stored pattern from the non-volatile operating memory.

* * * * *